United States Patent [19]

Hargassner et al.

[11] 4,069,863

[45] Jan. 24, 1978

[54] PLATE MOULD FOR CONTINUOUSLY CASTING STEEL STRANDS

[75] Inventors: Reinhard Hargassner, Leonding; Günter Holleis, Linz, both of Austria

[73] Assignee: Vereinigte Osterreichische Eisen- und Stahlwerke - Alpine Montan Aktiengesellschaft, Linz, Austria

[21] Appl. No.: 760,998

[22] Filed: Jan. 21, 1977

[30] Foreign Application Priority Data

Jan. 27, 1976 Austria ..... 529/76

[51] Int. Cl.[2] ..... B22D 11/12; B22D 33/04

[52] U.S. Cl. ..... 164/436; 164/341; 164/443

[58] Field of Search ..... 164/273 R, 283 M, 339, 164/341, 273 M, 292, 385, 386, 393, 395; 241/81.1, 81.2; 269/234; 403/83, 374, 376, 381

[56] References Cited

U.S. PATENT DOCUMENTS

| | | | |
|---|---|---|---|
| 3,710,845 | 1/1973 | Burkhardt et al. | 164/273 R |
| 3,874,804 | 4/1975 | Siegal | 403/381 X |

*Primary Examiner*—Robert D. Baldwin
*Assistant Examiner*—John S. Brown
*Attorney, Agent, or Firm*—Brumbaugh, Graves, Donohue & Raymond

[57] ABSTRACT

A plate mould for continuously casting steel has a carrying frame, and side and end walls with cooling devices. At least one side wall is movable transversely relative to the mould by separate apparatus. The end walls are each comprised of a holding plate, a supporting plate and a cooled copper plate and can be clamped between the side walls by spring clamping elements. Wedge-shaped noses are provided on the upper and lower edges of the supporting plate for engagement with a wedge-shaped groove in the pertaining holding plate and with a clamping piece, respectively.

7 Claims, 5 Drawing Figures

PLATE MOULD FOR CONTINUOUSLY CASTING STEEL STRANDS

BACKGROUND OF THE INVENTION

The invention relates to a plate mould for continuously casting steel, which mould has a carrying frame and walls supported therein that are provided with cooling means and delimit the mould cavity at least one side wall is movable transversely relative to the mould axis and the end walls are comprised of a holding plate, a supporting plate and a cooled copper plate that can be clamped between the side walls.

In continuous casting plants it is necessary to be able to quickly change or exchange the end walls for changing the dimensions, in particular the thickness, of continuously cast slabs.

Plate moulds have been known which allow for an exchange of the end walls, but their removal and installation requires a lot of work and time and thus for substantial periods of time the plant is at a standstill. In a known plate mould, hydraulic cylinders are used for clamping the end walls between the side walls, the hydraulic cylinders being supported against the carrying frame. This design has the disadvantage that the clamping force is dependent upon pressure fluctuations in the hydraulic system; if the mould is turned off for a long period of time, the cylinders become unpressurized. When the hydraulic system fails, there is an immediate danger of a breakthrough of the molten core of the slab, since the side walls are pressed apart.

In the known plate mould the end walls are fixed on the carrying frame by a hang-in and bracing means, wherein the hang-in means for an end wall has a T-shaped guide in the supporting plate and a sliding block that is resiliently fixed on the carrying frame via a bolt. With such a hang-in means a quick exchange of the end walls is not possible. A further disadvantage which has to be stressed is the fact that the resilient fastening of the end walls on the frame permits position changes when the casting conditions change. Such position changes of the end walls have an extremely detrimental influence upon the quality of the slab.

SUMMARY OF THE INVENTION

The invention aims at preventing the above-described disadvantages and difficulties and has as its object, on the one hand, to increase the safety of the clamping means and thus the operational safety of the plant and, on the other hand, to enable a quick exchange of the end walls of the plate mould.

According to the invention, this object is achieved in that the end walls, whose pertaining supporting plate is provided with wedge-shaped noses at its upper and lower edges, has the lower nose engaged in a wedge-shaped groove of the holding plate and the upper nose secured on the holding plate with a clamping piece backing up the nose. The end walls can be clamped between the side walls by a spring clamping means and the loose-side side wall is moved by a separate hydraulically or mechanically acting means which is supported on the carrying frame.

Advantageously, telescopically retractable and extendible pipes are provided between the water box of the mould and bores in the holding and supporting plates, respectively, which pipes supply and drain cooling water to and from the copper plate, which is provided with cooling channels.

Suitably, the spring clamping means comprises a drawing anchor penetrating the side walls, clamping nuts fixing the drawing anchor on the fixed-side wall, a spacer block adapted to the respective slab thickness, and a laminated spring. The pre-stress of the spring is adjustable by adjusting nuts.

According to a preferred embodiment, the end wall can be actuated by a drive that is displaceable in the direction perpendicular to the side walls of the mould and is mounted on the water box. By means of this drive the dimensions of the mould and the inclination of the end wall are adjustable. Because of the displaceability of the drive it is possible to adjust the drive to the new mould center plane when an end wall has been exchanged for another end wall of a different width. Thus jamming of the end wall between the side walls is avoided when the lengths of the side walls change during casting due to temperature fluctuations, since the frictional forces that occur between the side walls and the end walls occur symmetrically to the drive. Suitably, the drive, having an adjustment spindle and a gear, is secured to a guide plate which is displaceable in guides secured to the water box, is adjustable to the center plane of the mould by means of a pressure medium cylinder and is fixable relative to the water box by a clamping means.

BRIEF DESCRIPTION OF THE DRAWINGS

The invention shall now be described in more detail by way of two embodiments and with reference to the accompanying drawings, wherein.

DESCRIPTION OF EXEMPLARY EMBODIMENTS

Figure 1:
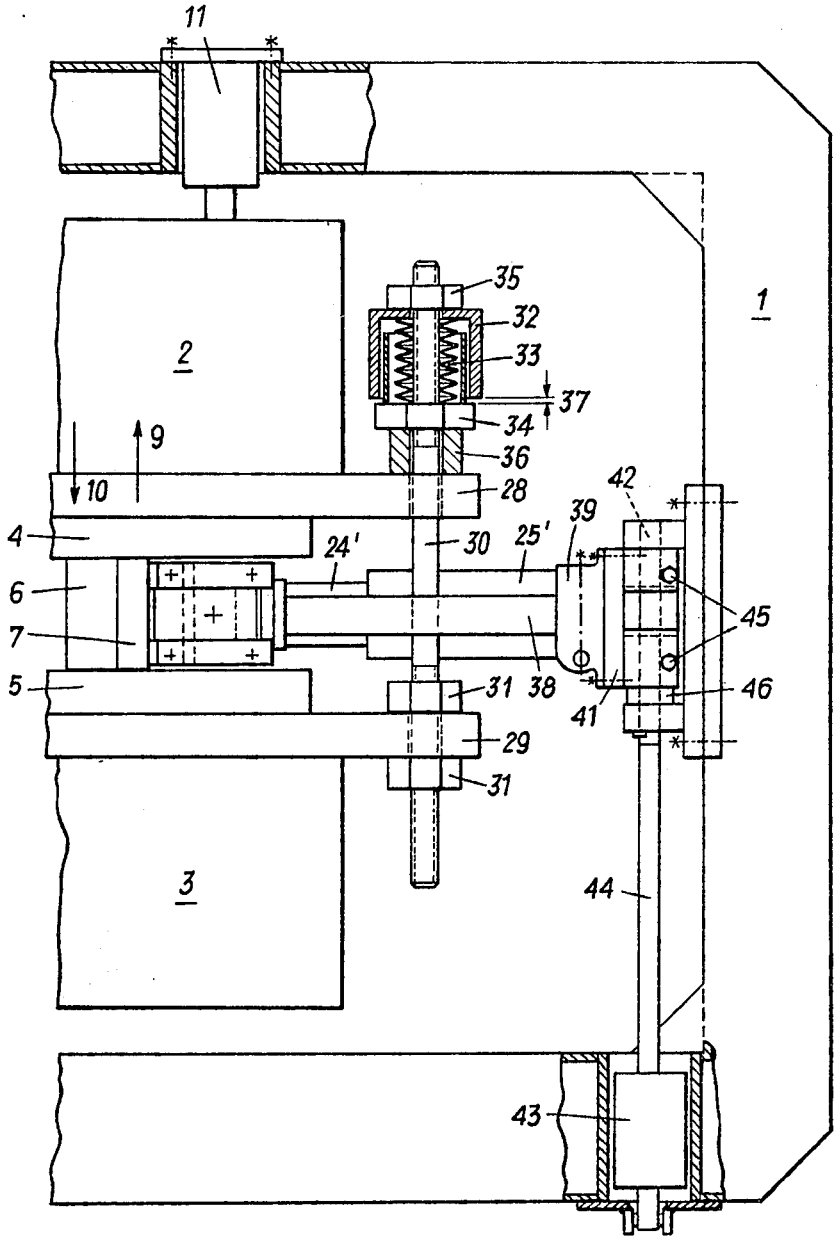
FIG. 1 is a horizontal plan view of the plate mould in the end wall region.
Figure 2:
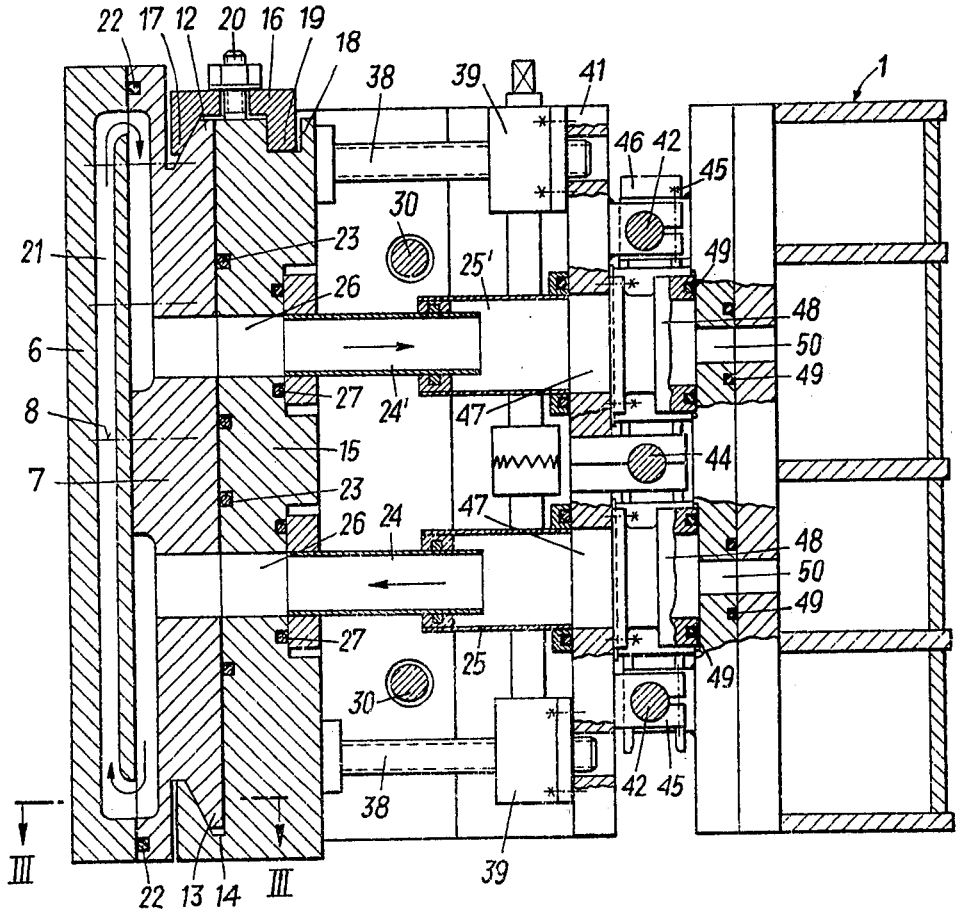
FIG. 2 is a vertical section through the end wall according to one embodiment.

In FIG. 1 a carrying frame of a mould designed as a water box is denoted by 1. In this frame loose side wall 2 and fixed side wall 3 of the mould are inserted. Each one of the two side walls is connected with copper plates denoted by 4 and 5. The end wall in the end wall region illustrated comprises a copper plate 6 and the supporting plate 7, which are connected to each other by screws 8 (FIG. 2). For moving the loose side wall in the direction of the arrows 9 and 10 (FIG. 1), a hydraulic cylinder 11 is provided, which cylinder is supported on the water box or carrying frame 1 and whose piston is connected to the loose-side wall 2.

As can be seen from FIG. 2, the supporting plate 7 is provided with wedge-shaped noses 12 and 13 at its upper and lower edges, the lower nose being hung on a wedge-shaped receiving groove 14 of a holding plate 15. At the upper edge the supporting plate 7 is connected with the holding plate 15 by a clamping piece 16 which has a flange 17 backing the nose 12 and a flange 19 engaged in a groove 18 of the holding plate. The clamping piece is braced on the nose 12 of the supporting plate and on the upper end of the holding plate 15 by means of a screw connection 20. Between the copper plate 6 provided with cooling channels 21 and the supporting plate 7 O-rings 22 are inserted, and between the supporting plate 7 and the holding plate 15 O-rings 23 are inserted. The water is supplied via telescopically retractable and extendible pipes 24 and 25, with the pipe 24 running into a bore 26 of the holding plate and sealed relative thereto by O-ring 27. The water is drained in the same manner via the telescoping pipes 24' and 25' in the upper part of the mould. As can be seen from FIG. 1, the end wall is clamped between the side walls 2 and 3, that is between their copper plates 4 and 5. The clamping means is comprised of a drawing anchor 30 penetrating the protruding plate-shaped parts 28 and 29 of the side walls 2 and 3, which drawing anchor is fastened on the fixed-side plate 29 by clamping nuts 31. On the other side there are provided a laminated spring 33 in a housing 32 as well as adjusting nuts 34 and 35 on the drawing anchor. Moreover, there is provided a spacer block 36 between the plate 28 and a nut 34 on the drawing anchor. The spacer block is adapted to the respective thickness of the slab. The play 37 between the lower edge of the housing and the adjusting nut 34 is the displacement path, which path is dimensioned in such a manner that the springs are not compressed to form a block. By 38 the displacement spindles and by 39 the displacement gears of the end wall are denoted.

Figure 3:
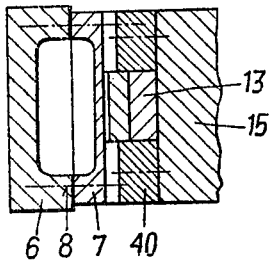
FIG. 3 is an enlarged illustration of a section along line III—III of FIG. 2, and FIGS. 4 and 5 show another embodiment of the invention in illustrations analogous to those of FIGS. 1 and 2.

From FIG. 3 it becomes apparent that for assuring the lateral position of the copper plate, the noses 13 are kept in their position by lateral holding pieces 40.

The detachment or installation of the end wall takes place in the following manner: The cylinders 11 are actuated, wherein the loose side wall 2 is moved in the direction of the arrow 9 and the play 37 is overcome. If the end wall only is exchanged, without a change of dimensions, the structural unit 6, 7 is exchanged for one of similar size. If the dimensions are also to be changed, the structural unit 6, 7 is exchanged for another one having the new desired dimensions. The screw connection 20 or other pressure means, such as a wedge or a bayonet catch which may be provided, are detached, the clamping piece 16 is lifted off and the unit 6, 7 is removed. In such a change to different dimensions the spacer block 36 also has to be exchanged in order to obtain the same pre-stress of the spring for clamping the end wall.

Altogether the procedure is the following: the loose-side side wall is detached in the direction of the arrow 9, the end wall is lifted out, the loose-side side wall is moved in the direction of the arrow 10, the new spacer blocks are inserted, the loose-side side wall is moved in the direction of the arrow 9 until play 37 has been overcome, the new end wall is inserted and the cylinder 11 is relieved.

The adjustment gears 39 are secured to a guide plate 41. The guide plate is displaceable along guide columns 42, mounted on the water box, by means of a piston rod 44 that can be actuated by a pressure medium cylinder 43. Clamping screws 45 serve for fixing the guide plate on the guide columns. By means of inserts 46, which can be pushed over the guide columns, the displacement path can be limited depending on the respective width of the end wall, so that the guide plate need only be displaed until it contacts the inserts. This results in an especially quick adjustment of the guide plate to the respective end wall. If the adjustment spindles 38 are in the mould center plane, they remain free from any bending moment strain such as can occur when the end wall jams due to frictional forces between the end walls and the side walls that are unsymmetrical with respect to the adjustment spindles.

The water supply and drain pipes 25 and 25' run into bores 47 of the guide plate 41 (FIG. 2). At the back of the guide plates the coolant conduits each continue with a pipe piece 48 rigidly secured to the guide plate and slidably guided on the water box. Sealing is effected by means of O-rings 49. In order to keep the water supply and drain openings 50 of the water box from being covered by a displacement of the guide plate 41, the pipe pieces 48 have diameters that are enlarged to the maximum displacement path relative to the openings 50. Covers, not shown, on the pipe pieces 48 are provided to keep the sliding faces on the water box free from dirt.

Figure 4:
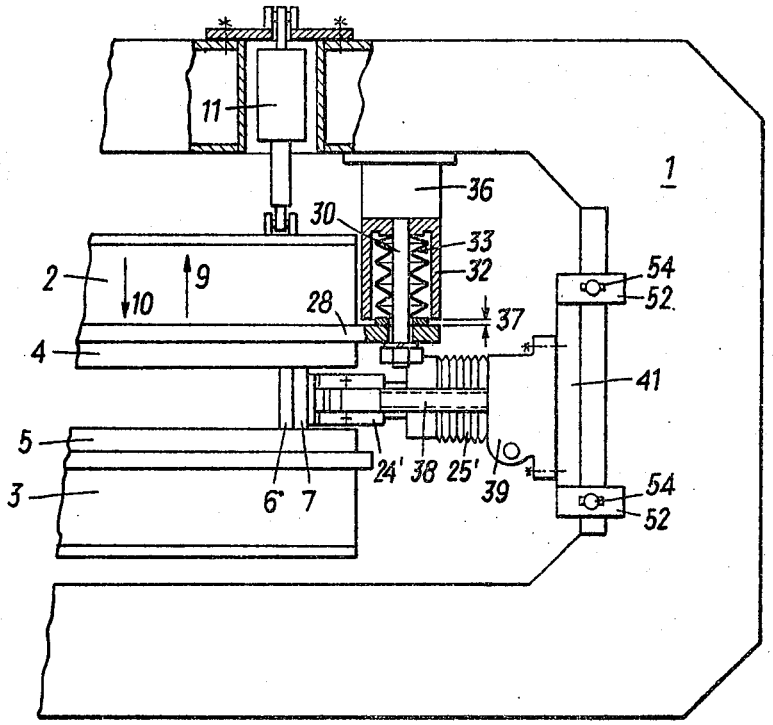
Figure 5:
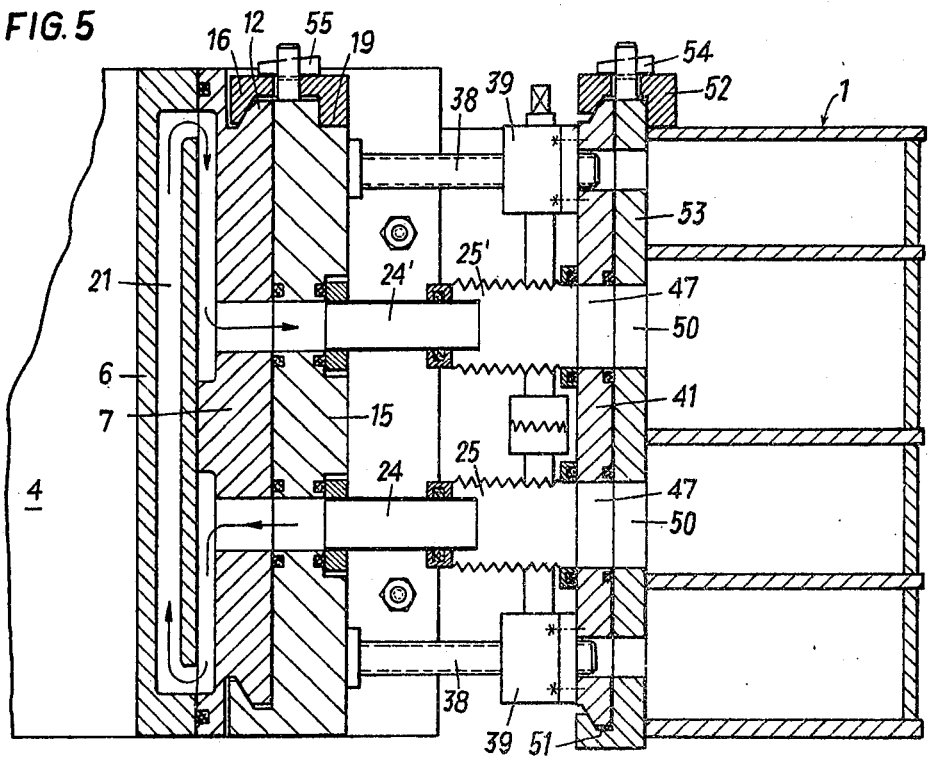

FIGS. 4 and 5 show an embodiment, which differs from the embodiment illustrated in FIGS. 1 to 3 in that the spring clamping means is supported on the water box on one side and on the loose side wall 2 on the other side. A further difference comprises the configuration of the guides of the guiding plate 41. The guiding plate 41 is guided without play with its lower end in a groove 51 having wedge-like arranged side faces. On the water box the guide plate can be fixed by a clamping piece 52 which embraces in a bracket-like manner the wall 53 of the water box as well as the upper end of the guide plate 41 and which can be secured to the wall of the water box by a wedge connection 54.

In this embodiment, the clamping piece 16 is also secured by a wedge connection 55 at the upper end of the holding plate 15.

The bores 47 of the guide plate provided for the water supply and drainage are arranged opposite the bores of the water box and are so dimensioned that when the guide plate is displaced, the free cross-section necessary for a sufficient supply of water to the mould always remains.

In this embodiment it is also possible to exchange the structural unit 6, 7 along with the displacement spindles 38, the displacement gears 39 with which it is connected and the guide plate 41, for a structural unit of different dimensions having fully assembled displacement spindles 38, displacement gears 39 and guide plate 41. This allows an especially quick exchange of the end walls to be carried out, since the drives need no longer be displaced. If time is available for the exchange of the end wall, suitably only the structural unit 6, 7 is exchanged and the guide plate is displaced together with the displacement drives and spindles to the new center of the mould.

We claim:

1. In a plate mould for continuously casting steel strands of the type including a carrying frame, side and end walls provided with cooling means, said walls delimiting the mould cavity and being supported in the carrying frame, at least one of the side walls being movable transverse to the mould axis to form a loose side, the end walls each being comprised of a holding plate, a supporting plate and a cooled copper plate and being capable of being clamped between the side walls, the improvement comprising:

a wedge-shaped upper nose provided at the upper edge of the supporting plate and a wedge-shaped lower nose provided at the lower edge of the supporting plate of each end wall, a wedge-shaped groove provided in the pertaining holding plate for engagement with the wedge-shaped lower nose, a clamping piece backing up the wedge-shaped upper nose and securing the upper nose to the respective holding plate, spring clamping means for clamping the end walls between the side walls, and a separate means for moving the at least one movable side wall forming the loose side, said separate means being supported on the carrying frame.

2. A plate mould as set forth in claim 1, wherein said separate means is a hydraulically active means.

3. A plate mould as set forth in claim 1, wherein said separate means is a mechanically active means.

4. A plate mould as set forth in claim 1, wherein the carrying frame is designed as a water box, the cooled copper plate of each end wall is provided with cooling channels, and the pertaining holding plate and the supporting plate both have bores, and further including telescopically retractable and extendible pipes provided between the carrying frame and the bores for supplying and draining cooling water to and from the cooled copper plate.

5. A plate mould as set forth in claim 1, wherein the spring clamping means comprises:

a drawing anchor penetrating the side walls, clamping nuts fixing the drawing anchor to a side wall, other than the at least one movable side wall, and forming a fixed side, a spacer block adapted to the respective strand thickness and located on the drawing anchor, a laminated spring located on the drawing anchor, and adjusting nuts provided on the drawing anchor for adjusting the pre-stress of the laminated spring.

6. A plate mould as set forth in claim 1, wherein the carrying frame is a water box and further including a drive for at least one of the end walls, said drive being mounted on the water box and being perpendicularly displaceable relative to the side walls of the mould for adjusting a certain mould size and a certain inclination of the pertaining end wall.

7. A plate mould as set forth in claim 6, wherein said drive includes an adjustment spindle and a gear, and further comprising a guide plate for mounting said drive thereon, guide columns secured to the water box for displaceably guiding the guide plate thereon, a pressure medium cylinder for adjusting the guide plate to the center plane of the mould, and a clamping means for the guide plate to fix said guide plate relative to the water box.

* * * * *